US012589287B2

(12) United States Patent
Liang

(10) Patent No.: US 12,589,287 B2
(45) Date of Patent: Mar. 31, 2026

(54) AUTOMATIC CARD DEALER

(71) Applicant: Weixing Chuangke (Shenzhen) Technology Co., Ltd., Shenzhen (CN)

(72) Inventor: Yaowen Liang, Shenzhen (CN)

(73) Assignee: Weixing Chuangke (Shenzhen) Technology Co., Ltd., Shenzhen (CN)

( * ) Notice: Subject to any disclaimer, the term of this patent is extended or adjusted under 35 U.S.C. 154(b) by 594 days.

(21) Appl. No.: 18/091,408

(22) Filed: Dec. 30, 2022

(65) Prior Publication Data

US 2023/0142919 A1 May 11, 2023

(51) Int. Cl.
*A63F 1/12* (2006.01)
*A63F 1/14* (2006.01)

(52) U.S. Cl.
CPC ..... *A63F 1/14* (2013.01)

(58) Field of Classification Search
CPC ..... A63F 1/12; A63F 1/14
USPC ..... 273/149 R
See application file for complete search history.

(56) References Cited

U.S. PATENT DOCUMENTS 4,832,342 A * 5/1989 Plevyak ..... A63F 1/12 273/149 R
5,356,145 A * 10/1994 Verschoor ..... A63F 1/12 273/149 R
5,718,427 A * 2/1998 Cranford ..... A63F 1/12 273/149 R
2006/0151946 A1 7/2006 Ngai
2009/0166970 A1* 7/2009 Rosh ..... A63F 1/14 273/149 R
2010/0283202 A1* 11/2010 Ho ..... A63F 1/14 273/149 R
2013/0026709 A1* 1/2013 Sampson ..... A63F 1/14 273/149 R
2015/0196834 A1 7/2015 Scheper et al.
2017/0319945 A1 11/2017 Riordan et al.

FOREIGN PATENT DOCUMENTS

CN 113198170 A * 8/2021 ..... A63F 1/062

OTHER PUBLICATIONS

Translation of CN-113198170-A (Aug. 3, 2021), Li.*

* cited by examiner

*Primary Examiner* — Dmitry Suhol
(74) *Attorney, Agent, or Firm* — Hemisphere Law, PLLC

(57) ABSTRACT

An automatic card dealer relates to the technical field of intelligent card machines, comprising a card dealing component for dealing cards and a rotating component for driving the card dealing component to rotate, wherein the card dealing component further comprises an installing seat and a card bin; a bottom surface of the card bin is arranged on the installing seat; a side surface of the card bin is a frame body; the frame body is provided with three edges and an opening for replacing a fourth edge; the top of the card bin is provided with a card port in which cards are put; and the top of the card bin is provided with a card compacting rod for compacting the cards.

6 Claims, 6 Drawing Sheets

AUTOMATIC CARD DEALER

TECHNICAL FIELD

The present invention relates to the technical field of intelligent card machines, in particular to an automatic card dealer.

BACKGROUND

With the development of poker games, various card shufflers and dealers have appeared for replacement of manual card shuffling and dealing. The existing card dealers have many card dealing structures, and are composed of a card sending mechanism for sending stacked cards out, and a rotating component that makes the card sending mechanism rotate along its central axis. Most card bins of the existing card dealers are closed, and only the tops of the card bins have openings, leading to inconvenience in taking cards in the card bins. The closed card bins can only be used for dealing cards of one size, resulting in poor user experience.

SUMMARY

In view of the defects and deficiencies of the prior art, the purpose of the present invention is to provide an automatic card dealer which has the advantages that the opening design on the top and side of the card bin is convenient to take cards in the card bin to achieve the purpose of convenient use of the card dealer, and the design of openings on two sides can also be suitable for putting the cards which are conventionally used and have different sizes in the market into the card bin to deal the cards.

To achieve the above purpose, the present invention adopts the following technical solution: an automatic card dealer comprises a card dealing component for dealing cards and a rotating component for driving the card dealing component to rotate, wherein the card dealing component further comprises an installing seat and a card bin; a bottom surface of the card bin is arranged on the installing seat; a side surface of the card bin is a frame body; the frame body is provided with three edges and an opening for replacing a fourth edge; the top of the card bin is provided with a card port in which cards are put; and the top of the card bin is provided with a card compacting rod for compacting the cards in the card bin.

The bottom of one edge of the frame body is provided with a card outlet; the card outlet is provided with a card dealing wheel and a rolling rod which rotates oppositely to the card dealing wheel; and a meshing part formed therebetween is used for driving and sending out the cards from the card bin to the card outlet.

The bottom surface of the card bin is provided with a card sending wheel, and the card sending wheel is used for sending the cards from the card bin to the meshing part.

The card sending wheel shares an output motor with the card dealing wheel.

The output motor is a double-shaft motor; one shaft of the double-shaft motor is in transmission connection with a gear set; the gear set drives the card sending wheel to rotate; the other shaft of the double-shaft motor is in transmission connection with a transmission chain; and the transmission chain drives the card dealing wheel to rotate.

The rotating component is provided with a base; the base is arranged at the bottom of the installing seat; an output shaft extending into a deceleration motor of the base is also arranged in the installing seat; a rotating disc in transmission connection with the output shaft of the deceleration motor is arranged in the base; a center line at the bottom of the installing seat is provided with a transmission rod assembled with the rotating disc; and when the deceleration motor drives the rotating disc to rotate, the rotating disc drives the transmission rod to rotate for driving the card dealing component to rotate along the center line.

The rotating disc comprises a one-way bearing and a bearing driven wheel sleeved on an outer ring of the one-way bearing; the transmission rod is assembled in an inner ring of the one-way bearing; the bearing driven wheel is in transmission connection with the output shaft of the deceleration motor; the bottom of the rotating disc is provided with reset members; the reset members are used for making the bearing driven wheel return to an original angle after rotating by certain angles, so that the bearing driven wheel drives the one-way bearing to rotate intermittently, and the one-way bearing drives the transmission rod to rotate intermittently; and the transmission rod drives the card dealing component on the installing seat to rotate intermittently.

A plurality of induction sheets are arranged at the inner circumference of the base, and a rotating inductor for sensing the induction sheets is arranged on the installing seat; and the rotating inductor is matched with the induction sheets to locate the card dealing direction of the card dealing component.

A control circuit board is also arranged in the installing seat; the top of the card bin is provided with an operation panel; a back of the operation panel is provided with a PCB; and the control circuit board is electrically connected with the PCB.

A battery electrically connected with the control circuit board is also arranged in the installing seat, and a charging port electrically connected with the control circuit board is arranged outside the installing seat.

After the above technical solution is used, the beneficial effects of the present invention are as follows: the structure of the card bin is improved and one edge of the frame body originally formed by four edges is removed, so that the side of the card bin has an opening which is matched with the card port arranged on the top of the card bin, so that the process of card placing and taking is easier. Because one side of the card bin is removed, the long edge of a card placed into the card bin can be beyond the card bin, which is suitable for putting the cards which are conventionally used and have different sizes in the market into the card bin to deal the cards.

BRIEF DESCRIPTION OF DRAWINGS

To more clearly describe the technical solutions in embodiments of the present invention or in the prior art, the drawings required to be used in the description of the embodiments or the prior art will be simply presented below. Apparently, the drawings in the following description are merely some embodiments of the present invention, and for those ordinary skilled in the art, other drawings can also be obtained according to these drawings without contributing creative labor.

Reference signs: 1. card dealing component; 11. card bin; 1101. card port; 111. taking groove; 112. pad block; 113. card outlet; 12. card sending wheel; 13. card dealing wheel; 1301. meshing part; 131. rolling rod; 14. card compacting rod; 15. charging port; 16. operation panel; 161. PCB; 2. rotating component; 21. base; 211. foam; 22. rotating disc; 221. transmission rod; 222. one-way bearing; 223. bearing driven wheel; 224. belt; 23. deceleration motor; 231. output gear; 24. rotating sensor; 25. induction sheet; 26. rail hole; 261. rail rod; 27. limiting rod; 271. reset member; 3. control circuit board; 4. battery; 5. output motor; 6. gear set; 7. transmission chain; 8. supporting rack.

DETAILED DESCRIPTION OF THE EMBODIMENTS

The present invention is further explained in detail below in combination with the drawings.

Specific embodiments are only used for explaining the present invention and not for limiting the present invention. After reading this specification, those skilled in the art may modify the embodiments without creative contributions, and the modifications within the scope of claims of the present invention are protected by the patent law.

Figure 1:
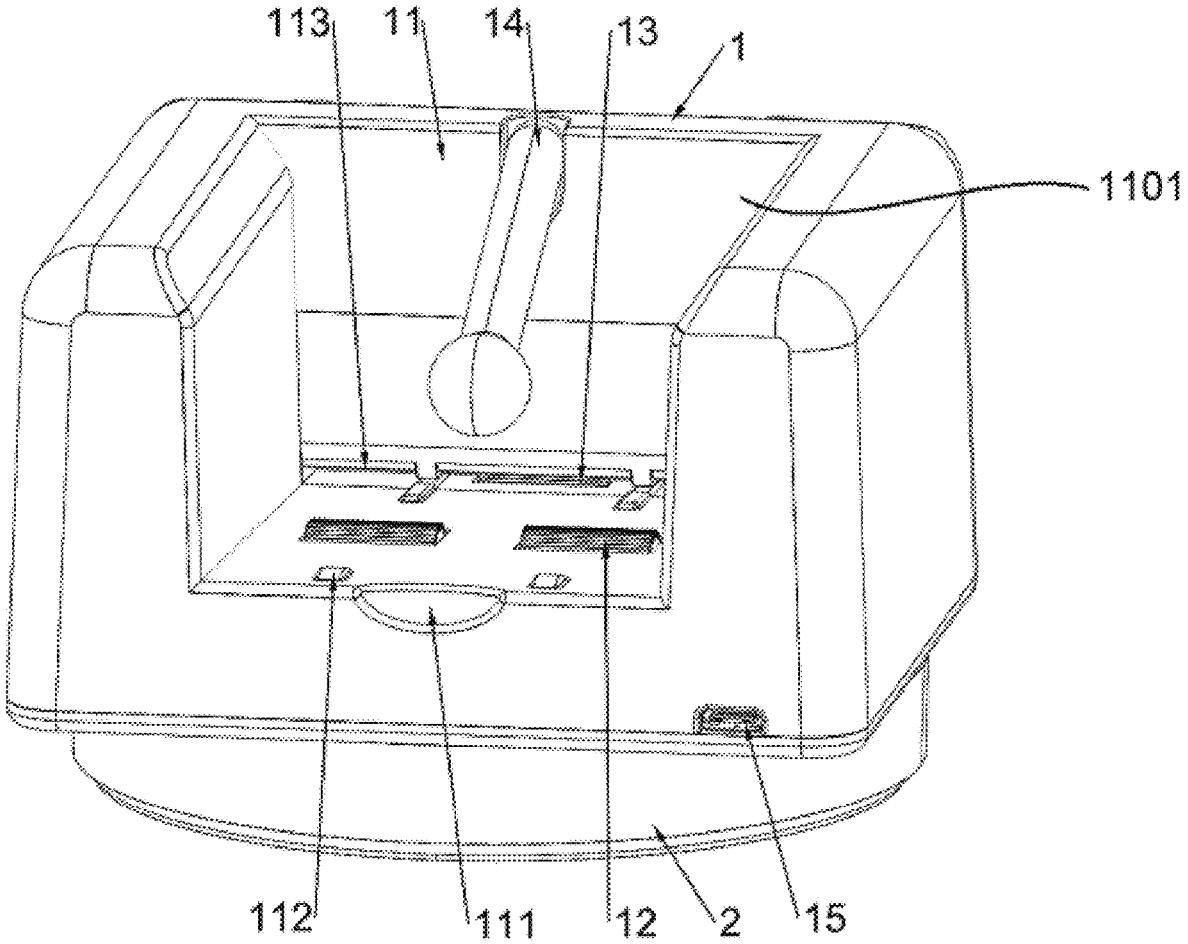
FIG. 1 is a structural schematic diagram of the present invention.

The present embodiment relates to an automatic card dealer, as shown in FIG. 1. The card dealer comprises a rotating component 2 arranged at the bottom and a card dealing component 1 arranged on the rotating component 2. The rotating component 2 can drive the card dealing component 1 to rotate along its center line, so that the card dealing component 1 deals cards around.

Preferably, a side surface of a card bin 11 is a frame body; the frame body is provided with three edges and an opening for replacing a fourth edge, so that the side of the card bin 11 has an opening which is matched with a card port 1101 arranged on the top of the card bin 11, so that the process of card placing and taking is easier. Because one side of the card bin 11 is removed, the long edge of a card placed into the card bin 11 can be beyond the card bin 11, which is suitable for putting the cards which are conventionally used and have different sizes in the market into the card bin to deal the cards.

Figure 2:
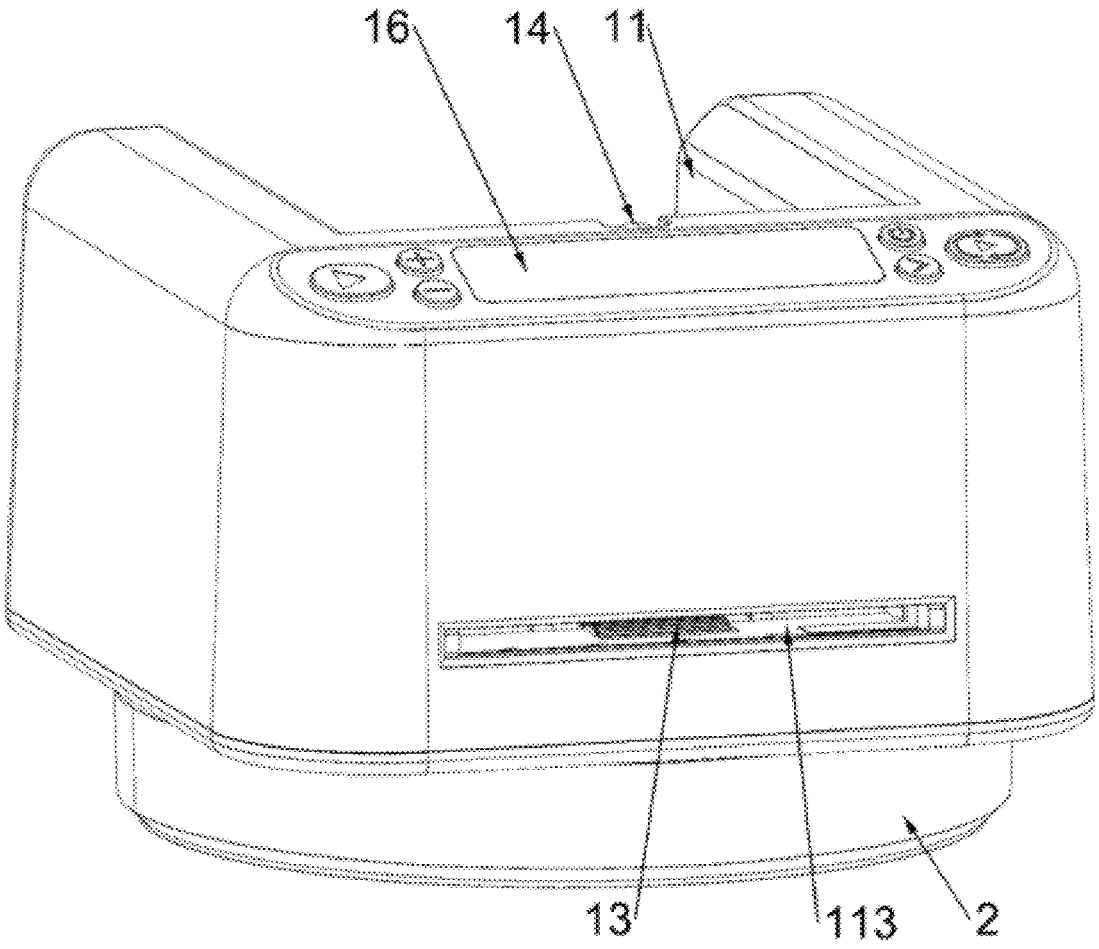
FIG. 2 is a schematic diagram corresponding to FIG. 1 from another angle.
Figure 3:
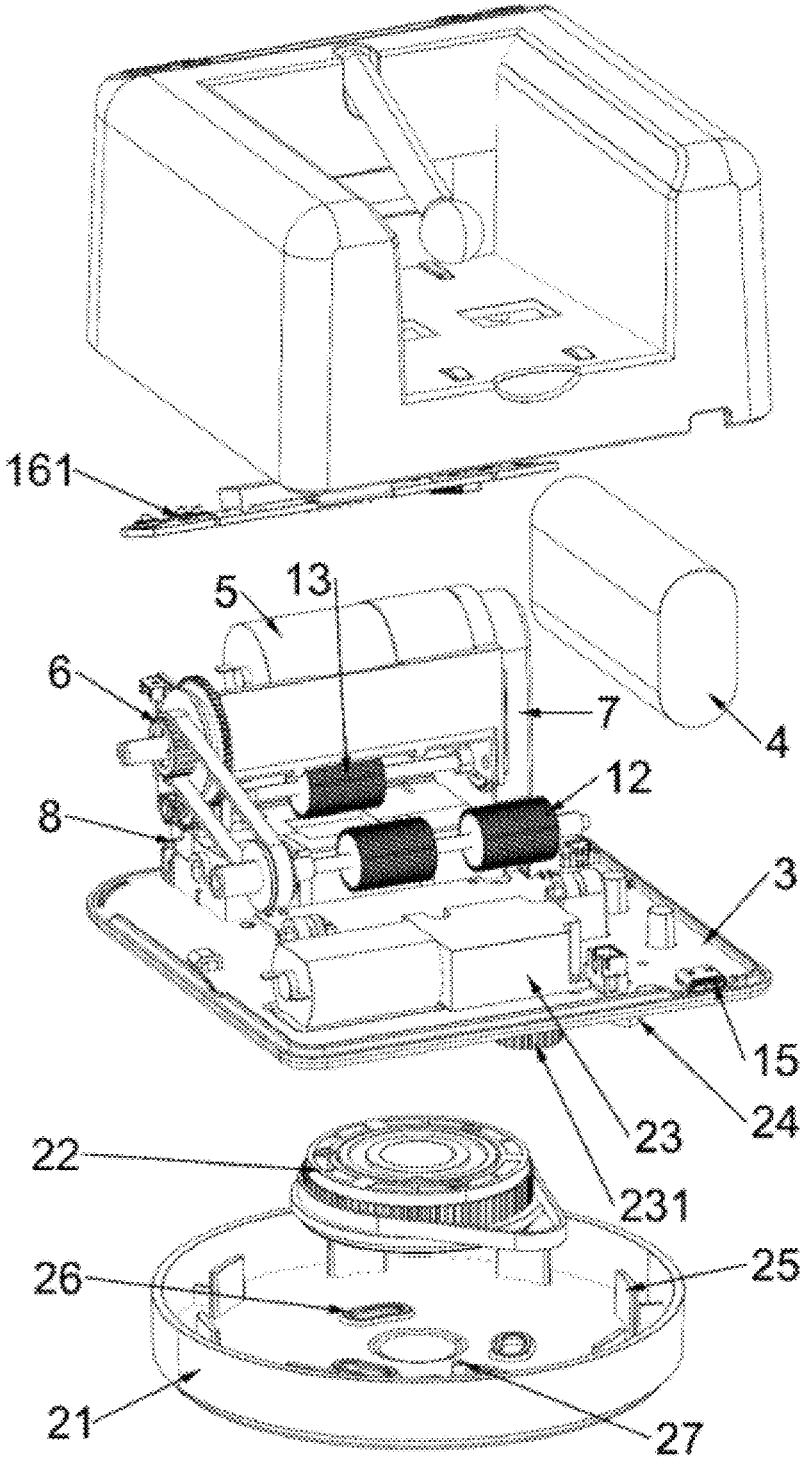
FIG. 3 is an exploded diagram corresponding to FIG. 1.

As shown in FIG. 2 and FIG. 3, it is necessary to add that a card outlet 113 is arranged at the bottom of one of the edges of the frame body; the card outlet 113 is located at the top of a base 21; the card outlet 113 is provided with a card dealing wheel 13 and a rolling rod 131 which rotates oppositely to the card dealing wheel 13, and a meshing portion therebetween forms a meshing part 1301, so that the cards in contact with the meshing part 1301 can be sent out from the card bin 11 to the card outlet 113, so as to complete a single card sending.

Figure 6:
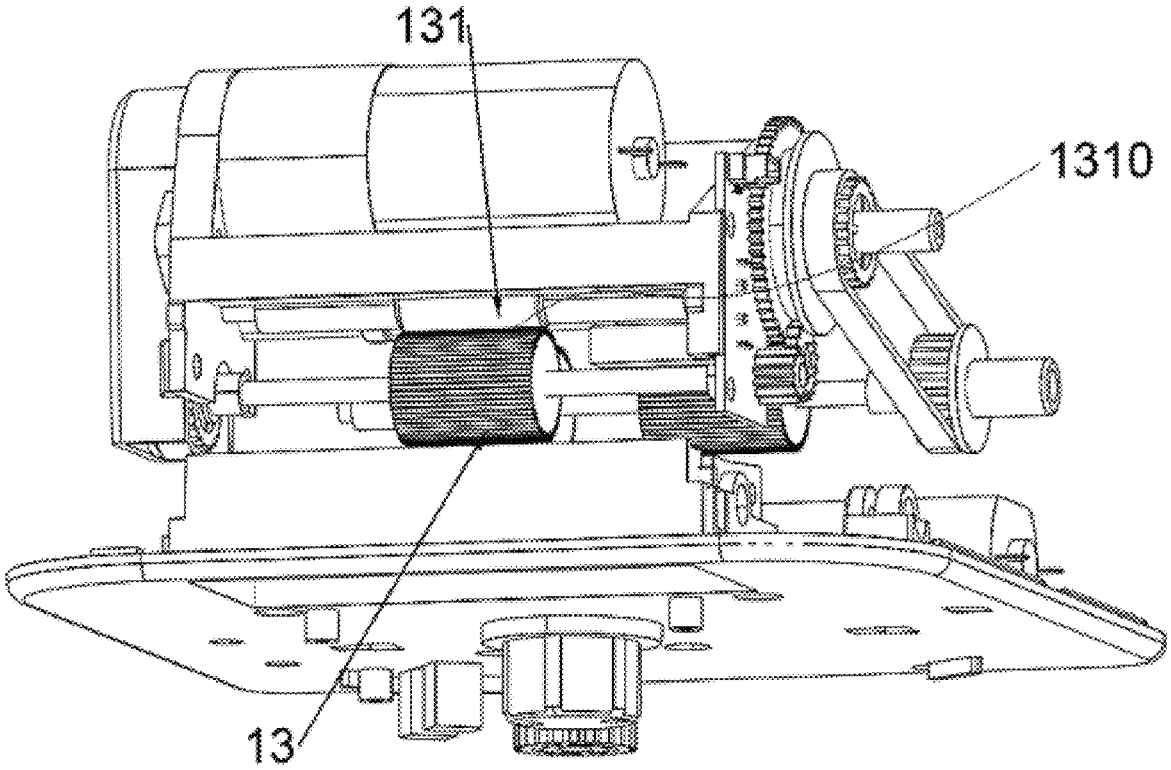
FIG. 6 is a structural schematic diagram of a card dealing wheel and a rolling rod of the present invention.

As shown in FIG. 6, an installing seat and the frame body are formed integrally, and a supporting rack 8 is arranged in the frame body and the installing seat; the card dealing wheel 13 is arranged on the supporting rack 8 close to the installing seat; and the rolling rod 131 which rotates oppositely to the card dealing wheel 13 is arranged in the frame body. The rolling rod 131 rotates when in contact with the card dealing wheel 13, and the two rotate in a way of mutual contact with the rotating surfaces, which can play the role of increasing the friction between the cards and the card dealing wheel 13 and reduce the probability of slipping, without increasing the resistance of the card dealing wheel 13. The top of the rolling rod 131 is provided with a spring which has the main function of offsetting the thickness of the cards and the uncertainty of surface states, to achieve smooth and uniform dealing.

It is necessary to add that the installing seat is arranged on the bottom surface of the card bin 11; the top of the installing seat is used for receiving the cards; a card sending wheel 12 is arranged at the contact position between the installing seat and the cards; and the card sending wheel 12 can send the cards placed on the installing seat to the card dealing wheel 13

It is necessary to add that the card sending wheel 12 shares an output motor 5 with the card dealing wheel 13. The output motor 5 is a double-shaft motor; one shaft of the double-shaft motor is in transmission connection with a gear set 6; the gear set 6 drives the card sending wheel 12 to rotate; the other shaft of the double-shaft motor is in transmission connection with a transmission chain 7; and the transmission chain 7 drives the card dealing wheel 13 to rotate, so that one output motor 5 can drive the card dealing wheel 13 and the card sending wheel 12 for transmission work; and one motor achieves the function of sending and dealing the cards, so that the internal structure of the frame body and the installing seat is compact in design and convenient in installation, to achieve the purposes of reducing the volume and facilitating the carrying.

In the present embodiment, the gear set 6, the double-shaft motor and the transmission chain 7 are assembled on the supporting rack 8.

Preferably, a control circuit board 3 is also arranged in the installing seat; the top of the card bin 11 is provided with an operation panel 16; the operation panel 16 can control the rotation angle and speed of the rotating component 2, can also control the card dealing speed of the card dealing component 1, and can also control the starting or closing of the entire card dealer; and a plurality of buttons are arranged on the operation panel 16, and are operated to realize the above functions.

It is necessary to add that a back of the operation panel 16 is provided with a PCB 161; the control circuit board 3 is electrically connected with the PCB 161; and the double-shaft motor is electrically connected with the control circuit board 3. A battery 4 electrically connected with the control circuit board 3 is also arranged in the installing seat, and a charging port 15 electrically connected with the control circuit board 3 is arranged outside the installing seat, so that the battery 4 can be charged to achieve the long-term use without external power.

In the present embodiment, the charging port 15 is Type-C charging port 15, and can be Micro USB interface or Lightning interface in other embodiments.

Preferably, the bottom surface of the card bin 11 is also the top of the installing seat; the bottom surface of the card bin 11 is provided with a pad block 112; the pad block 112 is protruded on the bottom surface of the card bin 11; the height of the pad block 112 is lower than the height at which the card sending wheel 12 protrudes out of the installing seat; a taking groove 111 is also arranged at the opening position of the frame body; the taking groove 111 is notched on the top of the installing seat; and the taking groove 111 is convenient for a user to take the cards from the card bin 11.

Preferably, the top of the card bin 11 is provided with a card compacting rod 14; the card compacting rod 14 is inclined; one end is connected to the top of the card bin 11 and the other end is inclined downward toward the center of the card bin 11; one end connected with the card bin 11 can be used for the card compacting rod 14 to rotate near or away from the center of the card bin 11; the card compacting rod 14 can exert downward pressure by gravity to increase the friction between the cards and the card sending wheel 12, so that the card sending wheel 12 can smoothly push the cards into the meshing part 1301 of the card dealing wheel 13 and the rolling rod 131.

Figure 4:
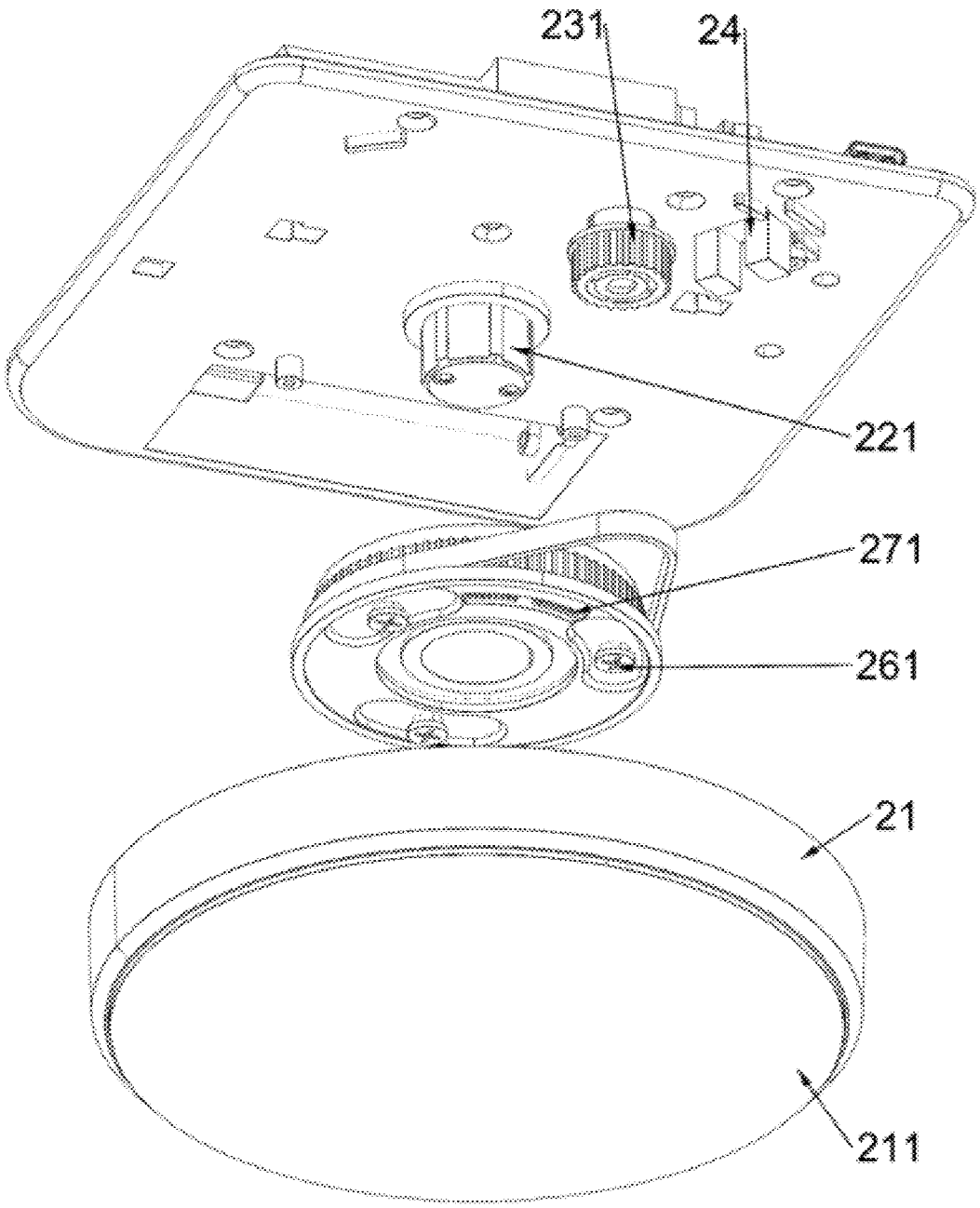
FIG. 4 is a partial structural schematic diagram corresponding to FIG. 3.
Figure 5:
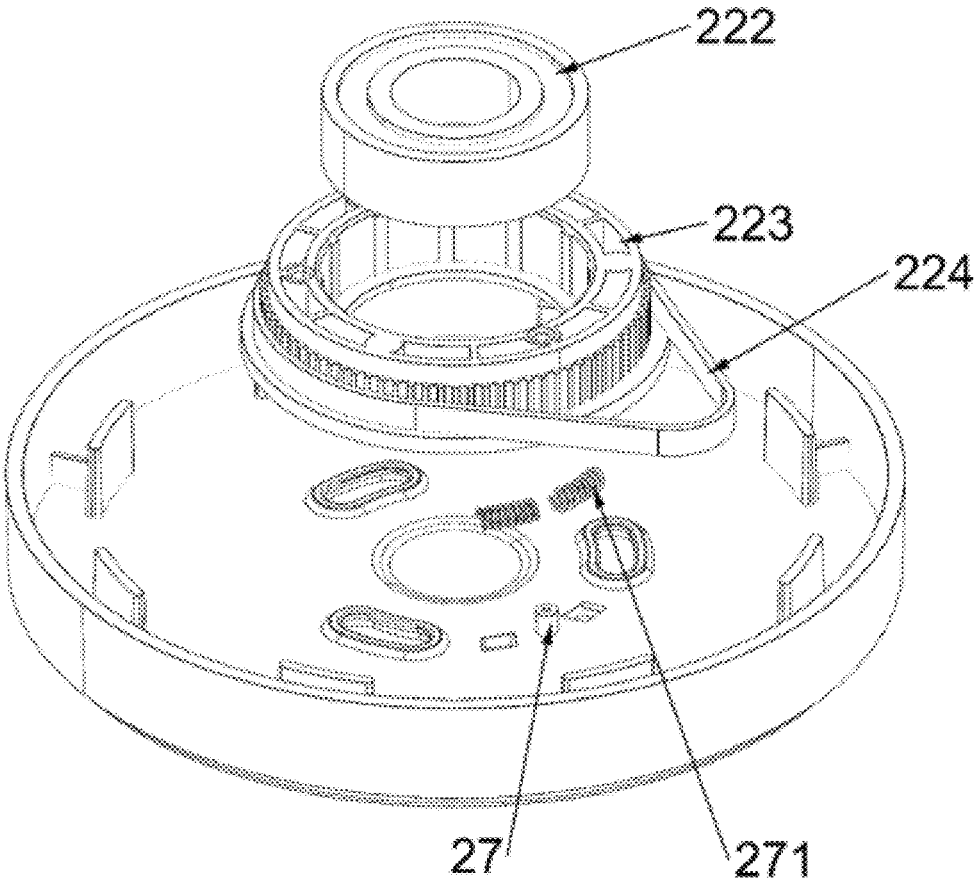
FIG. 5 is an exploded diagram of a rotating disc of the present invention.

As shown in FIG. 4 and FIG. 5, the rotating component 2 is provided with a base 21; the base 21 is arranged at the bottom of the installing seat; an output shaft extending into a deceleration motor 23 of the base 21 is also arranged in the installing seat; a rotating disc 22 in transmission connection with the output shaft of the deceleration motor 23 is arranged in the base 21; a center line at the bottom of the installing seat is provided with a transmission rod 221 assembled with the rotating disc 22; and when the deceleration motor 23 drives the rotating disc 22 to rotate, the rotating disc 22 drives the transmission rod 221 to rotate for driving the card dealing component 1 to rotate along the center line.

It is necessary to add that in the solution, the rotating disc 22 comprises a one-way bearing 222 and a bearing driven wheel 223 sleeved on an outer ring of the one-way bearing 222; the transmission rod 221 is assembled in an inner ring of the one-way bearing 222; the bearing driven wheel 223 is in transmission connection with the output shaft of the deceleration motor 23; the bottom of the rotating disc 22 is provided with reset members 271; the reset members 271 are used for making the bearing driven wheel 223 return to an original angle after rotating by certain angles, so that the bearing driven wheel 223 drives the one-way bearing 222 to rotate intermittently, and the one-way bearing 222 drives the transmission rod 221 to rotate intermittently; and the transmission rod 221 drives the card dealing component 1 on the installing seat to rotate intermittently.

It is necessary to add that the inner ring of the one-way bearing 222 does not move when the bearing driven wheel 223 of the outer ring rotates with the deceleration motor 23, and is driven to rotate when the bearing driven wheel 223 returns; and the deceleration motor 23 can rotate intermittently, so as to realize the above steps.

In the present embodiment, the output shaft of the deceleration motor 23 is provided with an output gear 231; the side surface of the bearing driven wheel 223 is provided with teeth; the bearing driven wheel 223 and the output gear 231 are located on the same horizontal plane, and are placed horizontally; and the bearing driven wheel 223 and the output gear 231 carry out transmission through a belt 224.

In the present embodiment, the reset members 271 are arranged in a spring groove at the bottom of the bearing driven wheel 223; the spring groove is set in an arc; the reset members 271 are two springs arranged at a starting end and a tail end of the spring groove, and a limiting rod 27 is arranged between the two springs; the limiting rod 27 is not fixed with the spring groove; the limiting rod 27 is fixedly assembled with the base 21; the limiting rod 27 is pressed by the two springs, so that a spring will be compressed after the bearing driven wheel 223 rotates by several angles in the forward or reverse direction; and when the deceleration motor 23 stops rotating, a resetting force generated by the compressed spring will drive the bearing driven wheel 223 to return, so that the one-way bearing 222 realizes intermittent rotation.

It is necessary to add that in start or emergency stop of the rotating component, if the reset member 271 is not provided, the entire device will shake and shift; and after the reset member 271 is installed, product shaking and shifting are solved, so as to ensure that the cards can be accurately dealt in position.

Rail rods 261 are arranged at the bottom of the rotating disc 22; the rail rods 261 extend into rail holes 26 on the inner bottom surface of the base 21; and the rail holes 26 are used to limit the rotation angle of the bearing driven wheel 223 provided with the rail rods 261. Three groups of rail holes 26 and rail rods 261 are arranged, and uniformly and circumferentially installed between the bearing driven wheel 223 and the inner bottom surface of the base 21.

Preferably, a plurality of induction sheets 25 are arranged at the inner circumference of the base 21, and a rotating inductor 24 for sensing the induction sheets 25 is arranged on the installing seat; and the rotating inductor 24 is matched with the induction sheets 25 to locate the card dealing direction of the card dealing component 1. When the rotating component 2 works, eight induction sheets 25 form an induction relationship with the rotating inductor 24, so that the rotating component 2 has eight fixed-point rotation positions, to realize the purpose of dealing the cards in designated positions.

In the present embodiment, the bottom surface of the base 21 is provided with foam 211, so as to reduce the vibration generated during card dealing and rotation of the card dealer.

The above is only used for describing, not for limiting, the technical solution of the present invention. Other modifications or equivalent replacements made to the technical solution of the present invention by those ordinary skilled in the art shall be covered within the scope of claims of the present invention without departing from the spirit and scope of the technical solution of the present invention.

What is claimed is:

1. An automatic card dealer, comprising a card dealing component (1) for dealing cards and a rotating component (2) for driving the card dealing component (1) to rotate, wherein the card dealing component (1) further comprises:

an installing seat;

a card bin (11); a bottom surface of the card bin (11) is arranged on the installing seat; a side surface of the card bin (11) is a frame body; the frame body is provided with three edges and an opening for replacing a fourth edge; the top of the card bin (11) is provided with a card port in which cards are put; and the top of the card bin (11) is provided with a card compacting rod (14) for compacting the cards in the card bin, wherein the bottom of one edge of the frame body is provided with a card outlet (113); the card outlet (113) is provided with a card dealing wheel (13) and a rolling rod (131) which rotates oppositely to the card dealing wheel (13); and a meshing part formed therebetween is used for driving and sending out the cards from the card bin (11) to the card outlet (113);

the bottom surface of the card bin (11) is provided with a card sending wheel (12), and the card sending wheel (12) is used for sending the cards from the card bin (11) to the meshing part;

the card sending wheel (12) shares an output motor (5) with the card dealing wheel (13); and the output motor (5) is a double-shaft motor; one shaft of the double-shaft motor is in transmission connection with a gear set (6); the gear set (6) drives the card sending wheel (12) to rotate; the other shaft of the double-shaft motor is in transmission connection with a transmission chain (7); and the transmission chain (7) drives the card dealing wheel (13) to rotate.

2. The automatic card dealer according to claim 1, wherein the rotating component (2) is provided with a base (21); the base (21) is arranged at the bottom of the installing seat; an output shaft extending into a deceleration motor (23) of the base (21) is also arranged in the installing seat; a rotating disc (22) in transmission connection with the output shaft of the deceleration motor (23) is arranged in the base (21); a center line at the bottom of the installing seat is provided with a transmission rod (221) assembled with the rotating disc (22); and when the deceleration motor (23) drives the rotating disc (22) to rotate, the rotating disc (22) drives the transmission rod (221) to rotate for driving the card dealing component (1) to rotate along the center line.

3. The automatic card dealer according to claim 2, wherein the rotating disc (22) comprises a one-way bearing (222) and a bearing driven wheel (223) sleeved on an outer ring of the one-way bearing (222); the transmission rod (221) is assembled in an inner ring of the one-way bearing (222); the bearing driven wheel (223) is in transmission connection with the output shaft of the deceleration motor (23); the bottom of the rotating disc (22) is provided with reset members (271); the reset members (271) are used for making the bearing driven wheel (223) return to an original angle after rotating by certain angles, so that the bearing driven wheel (223) drives the one-way bearing (222) to rotate intermittently, and the one-way bearing (222) drives the transmission rod (221) to rotate intermittently; and the transmission rod (221) drives the card dealing component (1) on the installing seat to rotate intermittently.

4. The automatic card dealer according to claim 3, wherein a plurality of induction sheets (25) are arranged at the inner circumference of the base (21), and a rotating inductor (24) for sensing the induction sheets (25) is arranged on the installing seat; and the rotating inductor (24) is matched with the induction sheets (25) to locate the card dealing direction of the card dealing component (1).

5. The automatic card dealer according to claim 1, wherein a control circuit board (3) is also arranged in the installing seat; the top of the card bin (11) is provided with an operation panel (16); a back of the operation panel (16) is provided with a PCB (161); and the control circuit board (3) is electrically connected with the PCB (161).

6. The automatic card dealer according to claim 5, wherein a battery (4) electrically connected with the control circuit board (3) is also arranged in the installing seat, and a charging port (15) electrically connected with the control circuit board (3) is arranged outside the installing seat.

* * * * *